US010508573B2

(12) United States Patent
Pedrini

(10) Patent No.: US 10,508,573 B2
(45) Date of Patent: Dec. 17, 2019

(54) BAFFLE ASSEMBLY FOR A DUCT

(71) Applicant: Solar Turbines Incorporated, San Diego, CA (US)

(72) Inventor: Luigi Antonio Pedrini, Cimo (CH)

(73) Assignee: Caterpillar Inc., Peoria, IL (US)

( * ) Notice: Subject to any disclaimer, the term of this patent is extended or adjusted under 35 U.S.C. 154(b) by 379 days.

(21) Appl. No.: 15/484,269

(22) Filed: Apr. 11, 2017

(65) Prior Publication Data

US 2018/0291781 A1 Oct. 11, 2018

(51) Int. Cl.

| | |
|---|---|
| ***F24F 13/24*** | (2006.01) |
| ***F24F 13/28*** | (2006.01) |
| ***F02C 7/045*** | (2006.01) |
| ***B64F 1/26*** | (2006.01) |
| ***F01N 1/08*** | (2006.01) |
| ***F01N 1/10*** | (2006.01) |
| *G10K 11/16* | (2006.01) |

(52) U.S. Cl.

CPC ..... *F01N 1/083* (2013.01); *F01N 1/10* (2013.01); *F23R 2900/00014* (2013.01)

(58) Field of Classification Search

CPC . F01D 15/10; F24F 13/24; F24F 13/28; F24F 2013/242; E04F 17/04; F02C 7/045; F02C 7/24; F04D 29/663; G10K 11/161; B64F 1/26

See application file for complete search history.

(56) References Cited

U.S. PATENT DOCUMENTS 2,160,638 A * 5/1939 Bedell ..... E04B 9/34 181/295
2,270,825 A * 1/1942 Parkinson ..... G10K 11/161 181/224
2,519,161 A * 8/1950 Tucker ..... G10K 11/16 181/284
2,706,013 A * 4/1955 Wigle ..... B64F 1/26 181/203
2,826,382 A * 3/1958 Hayden ..... B64F 1/26 181/210
3,195,679 A * 7/1965 Duda ..... B64F 1/26 181/222
3,347,338 A * 10/1967 Childress ..... B64F 1/26 181/203
3,435,911 A * 4/1969 Greenheck ..... F24F 13/075 181/224
4,276,954 A * 7/1981 Romano ..... E06B 7/084 160/236
5,268,541 A * 12/1993 Pettersson ..... F24F 13/24 181/224
5,532,439 A 7/1996 Minkin
(Continued)

*Primary Examiner* — Edgardo San Martin
(74) *Attorney, Agent, or Firm* — James R. Smith; Procopio, Cory, Hargreaves & Savitch LLP

(57) ABSTRACT

A noise attenuation baffle assembly for a duct, is provided. The baffle assembly includes a number of baffles arranged in a spaced apart relation to one another. Each baffle includes a first side and a second side. The baffle assembly further includes a first bracket coupled to the first side of each baffle of the number of baffles. The baffle assembly further includes a second bracket coupled to the second side of each baffle of the number of baffles. The first and the second bracket are configured to be coupled to the duct.

19 Claims, 9 Drawing Sheets

(56) References Cited

U.S. PATENT DOCUMENTS

| | | | | |
|---|---|---|---|---|
| 5,728,980 | A * | 3/1998 | Zarnick | E04F 17/04 181/224 |
| 6,405,825 | B1 * | 6/2002 | Yabe | B60R 13/0838 123/198 E |
| 6,451,079 | B1 * | 9/2002 | Lange | B01D 46/0002 55/379 |
| 6,851,514 | B2 | 2/2005 | Han et al. | |
| 7,009,839 | B2 | 3/2006 | Clinard | |
| 8,240,429 | B1 * | 8/2012 | Singhal | H02K 5/20 181/212 |
| 8,272,475 | B2 * | 9/2012 | Helenius | F24F 13/24 181/224 |
| 9,376,928 | B2 * | 6/2016 | Lazzari | F01D 15/10 |
| 10,119,469 | B2 * | 11/2018 | Ponyavin | F02C 7/045 |
| 2006/0144637 | A1 | 7/2006 | Swartz et al. | |
| 2006/0272888 | A1 | 12/2006 | Lucas et al. | |
| 2012/0097479 | A1 | 4/2012 | Kelly et al. | |
| 2015/0076097 | A1 | 3/2015 | Powers et al. | |

* cited by examiner

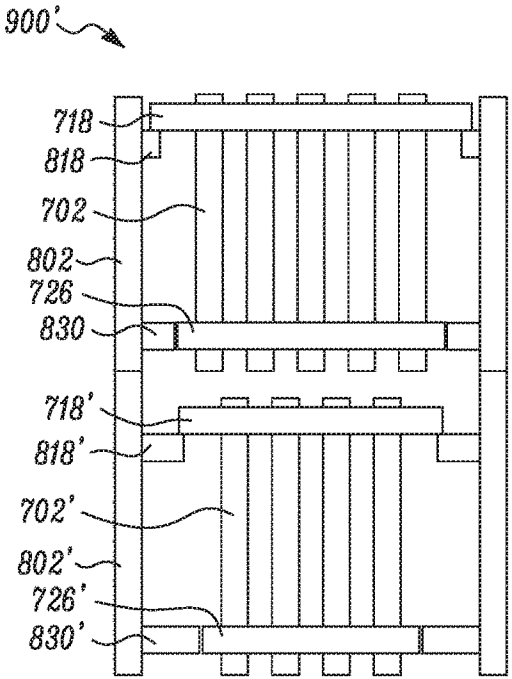
FIG. 10a
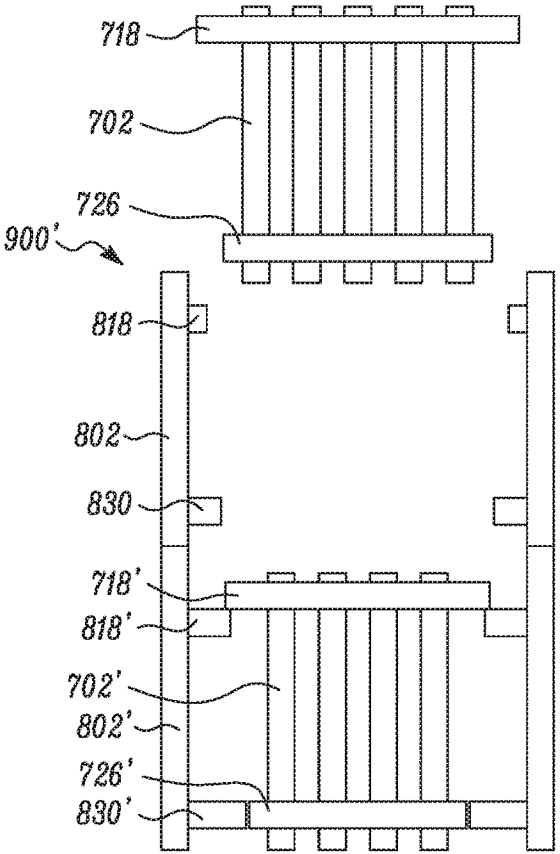
FIG. 10b
FIG. 10c

BAFFLE ASSEMBLY FOR A DUCT

TECHNICAL FIELD

The present disclosure relates to a duct for a machine, such as a turbine engine. More particularly, the present disclosure relates to a noise attenuation baffle assembly for the duct.

BACKGROUND

Machines, such as turbine engines, may develop noises during operation. These noises may spread into the environment of the machine through one or more ducts defining flow passages for the machine, which, for example, feed fresh air to a compressor or discharge exhaust gases from the turbine engine. In order to reduce the noise emission into the environment, it is a conventional practice to arrange a silencer in the ducts.

The silencer includes a number of baffles made of noise absorbing material that are positioned inside the duct. Conventionally, the baffles are individually connected to an inner surface of the duct. This results in an inflexible and expensive duct design. Further, the assembling/welding of each baffle into the duct is a difficult and expensive task. Furthermore, the baffles once assembled and/or mounted, are difficult to access for maintenance, thereby resulting in an extended downtime of the turbomachine. Moreover, upgrading the duct and/or the silencer to comply with new noise requirements may necessitate a new duct or a redesigned and rebuilt duct.

US Patent publication no. 2015/0076097 relates to a baffle plate assembly for installation in a rack structure. The baffle plate assembly directscooling air from a front side of the rack structure to a cooling air inlet and blocks heated air from below or behind the baffle plate assembly from entering the cooling air inlet. The baffle plate assembly includes a baffle plate defining a first surface plane, a pair of side plates, and a pair of mounting brackets. The side plates extend along the baffle plate while the mounting brackets are attached to the side plates. Further, the baffle plate first surface plane forms an oblique angle with respect to a plane defined by a first plate member of the mounting brackets.

SUMMARY OF THE INVENTION

According to an aspect of the present disclosure, a noise attenuation baffle assembly configured to be positioned inside a duct, is provided. The baffle assembly includes a number of baffles arranged in a spaced apart relation to one another. Each baffle includes a first side and a second side. The baffle assembly further includes a first bracket coupled to the first side of each baffle of the number of baffles. The baffle assembly further includes a second bracket coupled to the second side of each baffle of the number of baffles. The first and the second bracket are configured to be coupled to the duct.

According another aspect of the present disclosure, a duct assembly is provided. The duct assembly is in communication with a turbine engine. The duct assembly includes a duct having an inner surface. The inner surface further includes a support structure. The duct assembly further includes a baffle assembly positioned inside the duct. The baffle assembly includes a number of baffles arranged in a spaced apart relation to one another. Each baffle includes a first side and a second side. The baffle assembly further includes a first bracket coupled to the first side of each baffle of the number of baffles. The baffle assembly further includes a second bracket coupled to the second side of each baffle of the number of baffles. The first and the second bracket engage with the support structure of the duct.

In a yet another aspect of the present disclosure, a method for assembling a duct assembly is provided. The duct assembly is used with at least one of a turbine engine or a turbine enclosure. The method includes arranging a number of baffles in a spaced apart relation to one another. Each baffle includes a first side and a second side. The method further includes coupling a first bracket to the first side and coupling a second bracket to the second side of each baffle in the number of baffles, to form the baffle assembly. Furthermore, the method includes positioning the baffle assembly inside a duct by engaging the first bracket and the second bracket with a support structure of the duct.

BRIEF DESCRIPTION OF THE DRAWINGS

FIGS. 10*a* to 10*c* illustrate steps for assembling the duct assembly, in accordance with an alternative embodiment of the present disclosure.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

The present disclosure relates to a noise attenuation baffle assembly configured to be positioned inside a duct. In an example, the baffle assembly may be positioned inside a duct of a turbine engine or a turbine engine enclosure, for suppressing turbine engine noise.

Figure 1:
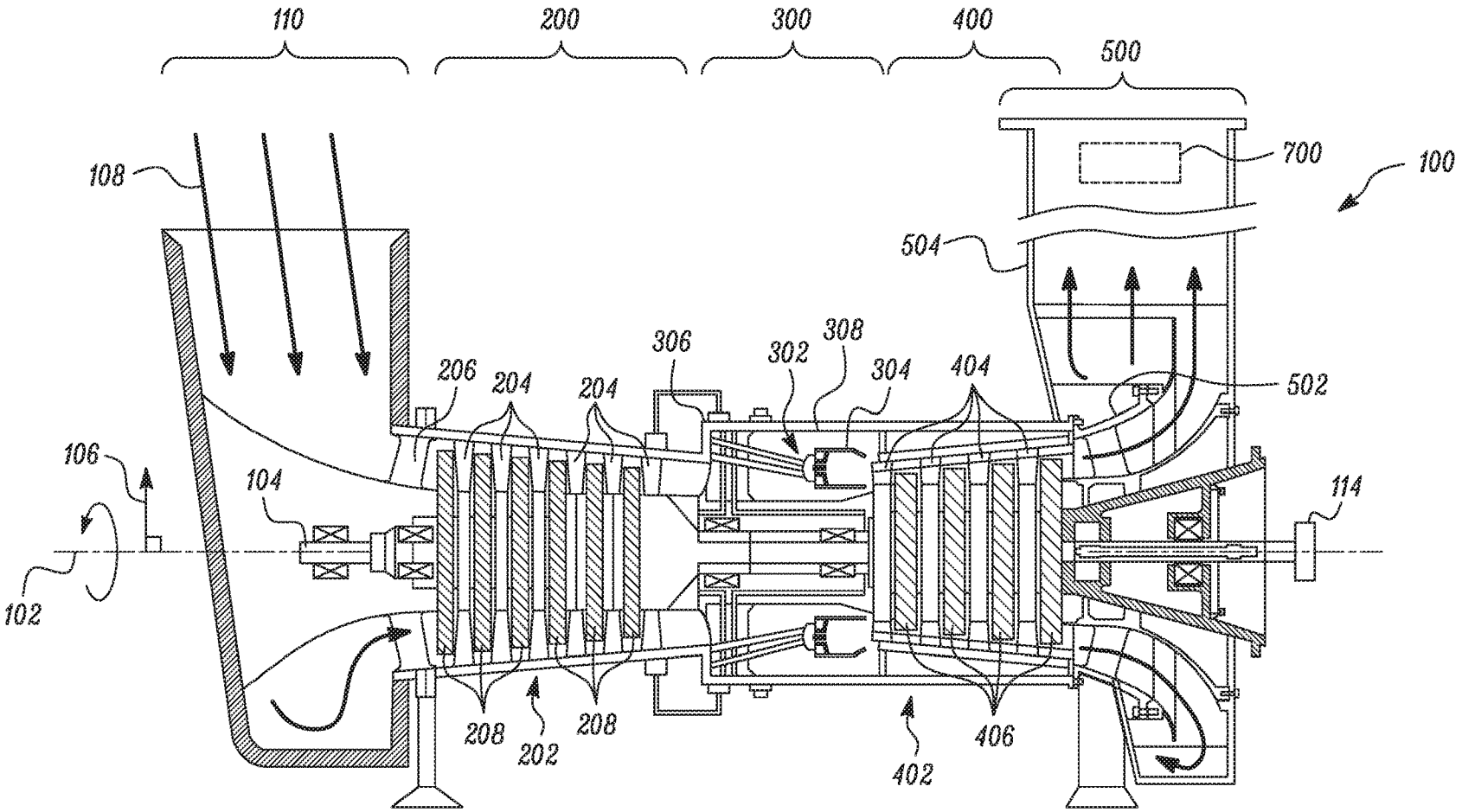
FIG. 1 illustrates a schematic representation of a gas turbine engine, in accordance with the concepts of the present disclosure.

FIG. 1 is a schematic illustration of an exemplary gas turbine engine 100. Some of the surfaces have been left out or exaggerated (here and in other figures) for clarity and ease of explanation. The disclosure may reference an axis of rotation of the gas turbine engine 100 ("center axis" 102), which may be generally defined by a longitudinal axis of its shaft 104. The center axis 102 may be common to or shared with various other engine concentric components. All references to radial, axial, and circumferential directions and measures refer to the center axis 102, unless specified otherwise, and terms such as "inner" and "outer" generally indicate a lesser or greater radial distance from, wherein a radial 106 may be in any direction perpendicular and radiating outward from the center axis 102. The gas turbine engine 100 illustrated in FIG. 1 has been depicted as having a single shaft configuration for better understanding of the present disclosure. However, it may be contemplated that in various other embodiments, the gas turbine engine 100 may have a dual shaft or a multi shaft configuration.

In addition, the disclosure may reference a forward and an aft direction. Generally, all references to "forward" and "aft" directions are associated with the flow direction of primary air (i.e., air used in the combustion process), unless specified otherwise. For example, forward is "upstream" relative to the primary air flow (i.e., towards the point where air enters the system), and aft is "downstream" relative to the primary air flow (i.e., towards the point where air leaves the system).

The gas turbine engine 100 may include an inlet 110, the shaft 104, a compressor 200, a combustor 300, a turbine 400, an exhaust 500, and a power output coupling 114.

The compressor 200 includes a compressor rotor assembly 202, compressor stationary vanes ("stators") 204, and inlet guide vanes 206. The compressor rotor assembly 202 mechanically couples to the shaft 104. As illustrated, the compressor rotor assembly 202 is an axial flow rotor assembly. The compressor rotor assembly 202 includes one or more compressor disk assemblies 208. Each of the compressor disk assemblies 208 includes a compressor rotor disk that is circumferentially populated with compressor rotor blades. The stators 204 axially follow corresponding compressor disk assemblies 208. Each compressor disk assembly 208 paired with the adjacent stator 204 that follow the compressor disk assembly 208 is considered to form a compressor stage. The compressor 200 includes multiple compressor stages. The inlet guide vanes 206 axially precede the compressor stages.

The combustor 300 includes one or more fuel injectors 302 and includes one or more combustion chambers 304. In the gas turbine engine 100 shown, each fuel injector 302 is installed into the combustor 300 in the axial direction relative to the center axis 102 through radial case portion 306 of combustor case 308. Each fuel injector 302 includes a flange assembly, an injector head and one or more fuel tubes extending between the flange assembly and the injector head (not shown). The fuel injectors 302 direct gaseous and liquid fuels into the combustion chambers 304.

The fuel delivered to the combustor 300 may include any known type of hydrocarbon based liquid or gaseous fuel. Liquid fuels may include diesel, heating oil, JP5, jet propellant, or kerosene. In some embodiments, liquid fuels may also include natural gas liquids (such as, for example, ethane, propane, butane, etc.), paraffin oil based fuels (such as, JET-A), and gasoline. Gaseous fuels may include natural gas. In some embodiments, the gaseous fuel may also include alternate gaseous fuels such as, for example, liquefied petroleum gas (LPG), ethylene, landfill gas, sewage gas, ammonia, biomass gas, coal gas, refinery waste gas, etc. This listing of liquid and gaseous fuels is not intended to be an exhaustive list but merely exemplary. In general, any liquid or gaseous fuel known in the art may be delivered to the combustor 300 through the fuel injectors 302.

The turbine 400 includes a turbine rotor assembly 402, and turbine nozzles 404. The turbine rotor assembly 402 mechanically couples to the shaft 104. As illustrated, the turbine rotor assembly 402 is an axial flow rotor assembly. The turbine rotor assembly 402 includes one or more turbine disk assemblies 406. Each turbine disk assembly 406 includes a turbine disk that is circumferentially populated with turbine blades (not shown). The turbine nozzles 404 axially precede each of the turbine disk assemblies 406. Each turbine disk assembly 406 paired with the adjacent turbine nozzles 404 that precede the turbine disk assembly 406 is considered as a turbine stage. The turbine 400 may include multiple turbine stages. The exhaust 500 includes an exhaust diffuser 502 and an exhaust duct 504. The exhaust duct 504 defines a flow passage for the exhaust air to exit the gas turbine engine 100.

In operation, the air enters the inlet 110 as a "working fluid", and is compressed by the compressor 200. The compressor 200 compresses the working fluid in an annular flow path 108 by the series of compressor rotor assemblies 202. Once compressed, the air leaves the compressor 200, and enters the combustor 300, where it is diffused and fuel is added. Fuel and some of the air are injected into the combustion chamber 304 via fuel injectors 302 and ignited. Some of the air is routed for cooling. After the combustion reaction, energy is then extracted from the combusted fuel/air mixture via the turbine 400 by a series of turbine rotor assemblies 402. Further, the exhaust gas leaves the gas turbine engine 100 via the exhaust 500. The exhaust gas may be diffused in the exhaust diffuser 502 and exit the gas turbine engine 100 via the exhaust duct 504.

Figure 2:
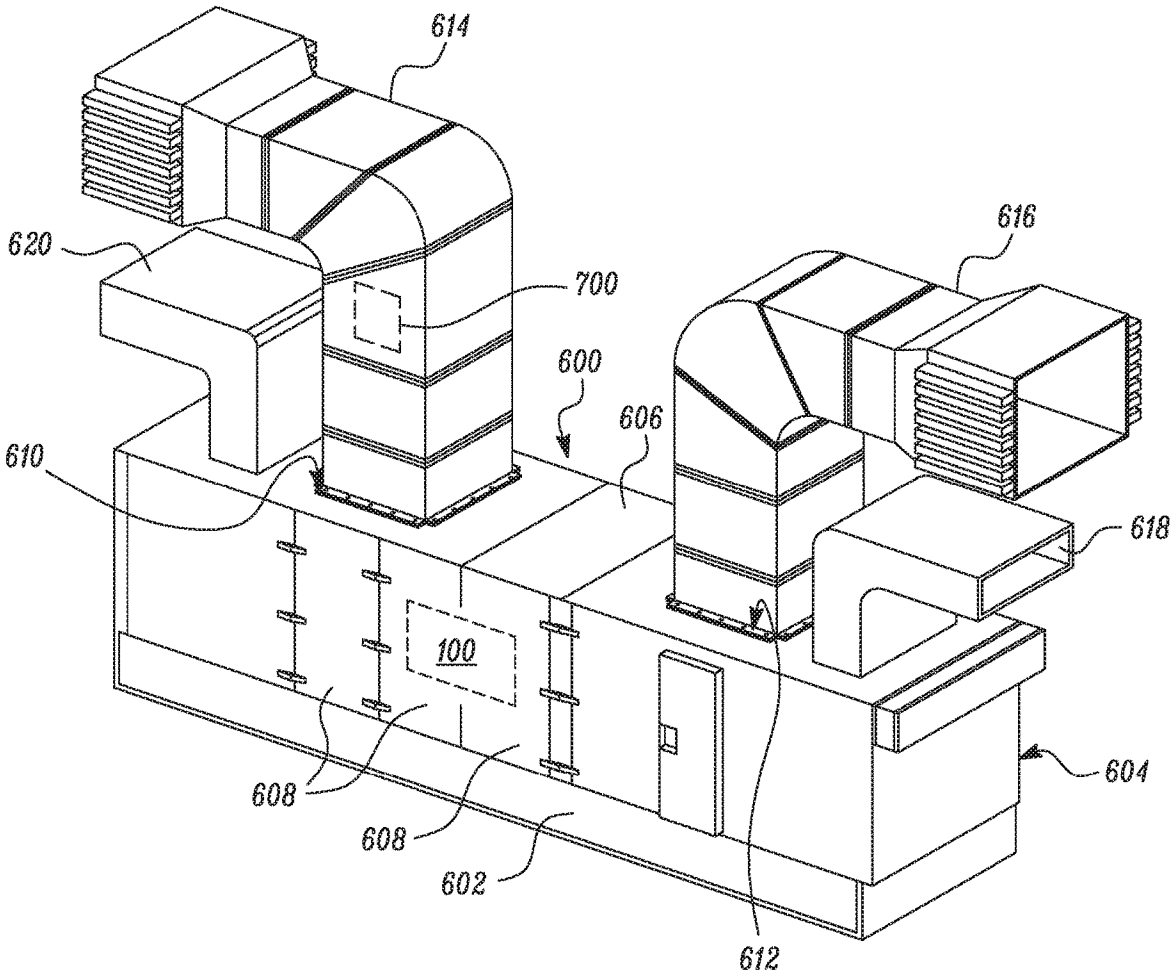
FIG. 2 illustrates a perspective view of a gas turbine engine package, in accordance with the concepts of the present disclosure.

FIG. 2 illustrates a perspective view of an enclosure 600 for a gas turbine engine package. The enclosure 600 may include an enclosure platform 602, enclosure walls 604, and an enclosure roof 606. The enclosure platform 602 may support the gas turbine engine package including the gas turbine engine 100 and any driven equipment connected to the gas turbine engine 100, such as a generator or gas compressor (not shown in FIG. 2).

The enclosure walls 604 extend up from the enclosure platform 602 and may be formed of enclosure panels 608. The enclosure panels 608 may generally be solid sheets that are joined together. The enclosure roof 606 may be joined to the enclosure walls 604. The enclosure roof 606 may include an enclosure gas turbine engine inlet 610 and an enclosure gas turbine engine outlet 612. The enclosure gas turbine engine inlet 610 may be an opening in the enclosure roof 606 that facilitates the connection of inlet ducting 614 to the inlet 110 of the gas turbine engine 100. The enclosure gas turbine engine outlet 612 may be an opening in the enclosure roof 606 that facilitates the connection of exhaust ducting 616 of the exhaust 500 of the gas turbine engine 100. The enclosure walls 604 may further include one or more ventilation air circuits 618, 620 to keep the system ventilated.

The ducts may be independent ducts or shrouds, forming the air passageways. Alternately, one or more ducts may be combined with other ducts so as to form a duct manifold, the duct manifold having a plurality of air passageways. In addition, the ducts or duct manifolds may be uninterrupted or made up of joined sections between inlet and exit.

In an embodiment of the present disclosure, a baffle assembly 700 is provided inside a duct, such as the exhaust duct 504 of the gas turbine engine 100 of FIG. 1. Alternatively, the baffle assembly 700 may be provided inside the inlet ducting 614 and/or the exhaust ducting 616 of the enclosure 600 of FIG. 2. In a yet another embodiment, the baffle assembly 700 may be provided inside the ducts of air ventilation circuits 618, 620 of the enclosure 600. It may be contemplated that the baffle assembly 700 may be positioned either inside a vertical section of the duct or in a horizontal section of the duct. The baffle assembly 700 may be a noise attenuation assembly that assists in suppressing turbine engine noise. The baffle assembly 700 is further described in greater detail with reference to FIGS. 3 to 6 in the following description.

Figure 3:
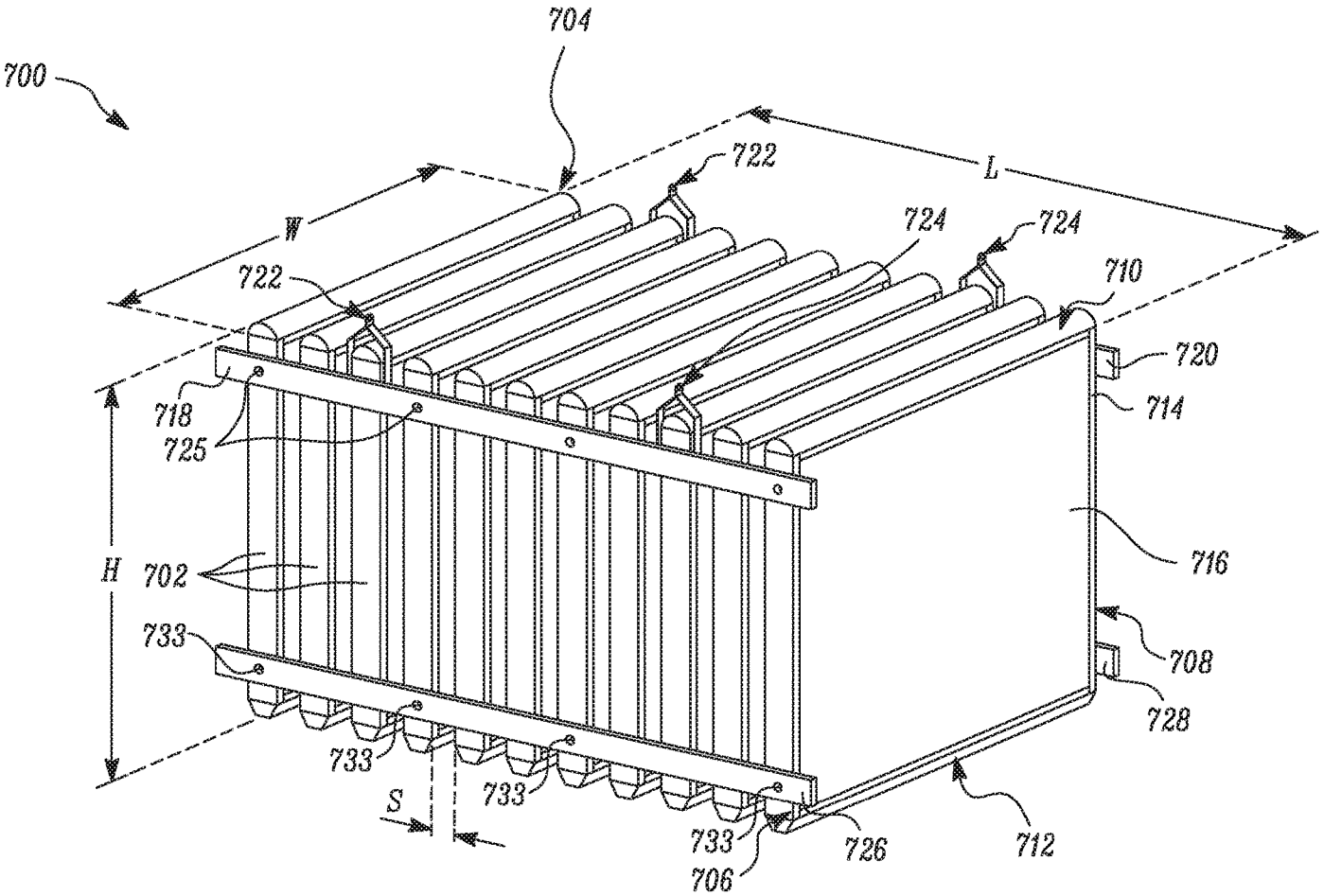
FIG. 3 illustrates an exemplary baffle assembly, in accordance with the concepts of the present disclosure.
Figure 4:
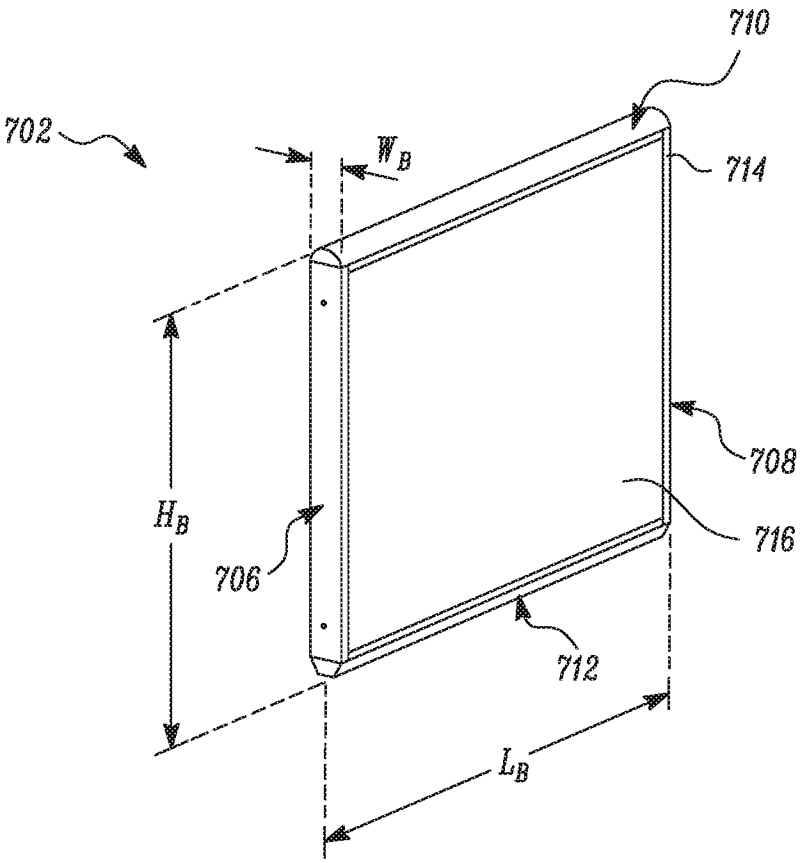
FIG. 4 illustrates a perspective view of an exemplary baffle of the baffle assembly of FIG. 3, in accordance with the concepts of the present disclosure.

FIG. 3 illustrates the baffle assembly 700 including a number of baffles 702 forming a baffle array 704, according to an embodiment of the present disclosure. FIG. 4 illustrates a perspective view of one of the baffles 702, according to the embodiment of the present disclosure. The baffles 702 may include noise absorbent material to absorb the noise generated in the gas turbine engine 100. In an embodiment of the present disclosure, all the baffles 702 in the baffle assembly 700 are identical in structure. However, different shapes and dimensions of every baffle 702 may also be contemplated without deviating from the scope of the claimed subject matter.

Each of the baffles 702 is arranged in a spaced apart relation to one another, to define a space S therebetween, as shown in FIG. 3. In an example, the baffles 702 may be arranged parallel to one another to form the baffle array 704 having a length L, width W and a height H. However, any other arrangement of these baffles 702 may also be contemplated based on a desired level of noise attenuation to be achieved.

Each baffle 702, in the baffle array 704, includes a first side 706 and a second side 708 laterally opposite to the first side 706. The baffle 702 further includes an inlet face 710 and an outlet face 712 configured to receive airflow and release airflow, respectively. The inlet face 710 may face the air coming from the exhaust diffuser 502 of the exhaust 500 and includes an arcuate shape to direct the received air through the space S towards the outlet face 712. The outlet face 712 includes a trapezoidal shape to further direct the received air out of the exhaust duct 504 of the gas turbine engine 100 and/or the exhaust ducting 616 of the enclosure 600. Although the profile shapes of the inlet face 710 and the outlet face 712 are illustrated as arcuate and trapezoidal respectively, it may be contemplated that any other profile shapes may also be used to achieve similar results without deviating from the scope of the claimed subject matter.

The baffle 702 further defines a pair of opposing walls 714 (only one side shown) configured to attach to a pair of noise absorbing sheets 716. The noise absorbing sheets 716 may be attached to the walls 714 of the baffle 702, by one or more of fasteners, adhesive or welding techniques. Each one of the baffles 702 may define a respective width $W_B$, height $H_B$, and length $L_B$.

Returning to FIG. 3, the baffle assembly 700 may further include a first bracket 718 and a second bracket 720 coupled to the first side 706 and the second side 708, respectively, of the baffles 702. In an embodiment of the present disclosure, the first bracket 718 and the second bracket 720 are coupled to each of the baffles 702 proximal to the inlet face 710. The first bracket 718 and the second bracket 720 are identical to each other and attach to the first side 706 and the second side 708 respectively in an identical manner, such as by use of mechanical fasteners, welding techniques, or other suitable fastening means. The first bracket 718 and the second bracket 720 are described in greater detail in conjunction to FIG. 5 along with FIG. 3 in the following description.

It may be contemplated that the second bracket 720, being identical to the first bracket 718, will include identical features as that of the first bracket 718 described herein. The first bracket 718 defines an elongated rectangular profile having a length $L_1$, which is greater than the length L of the baffle array 704.

Figure 5:
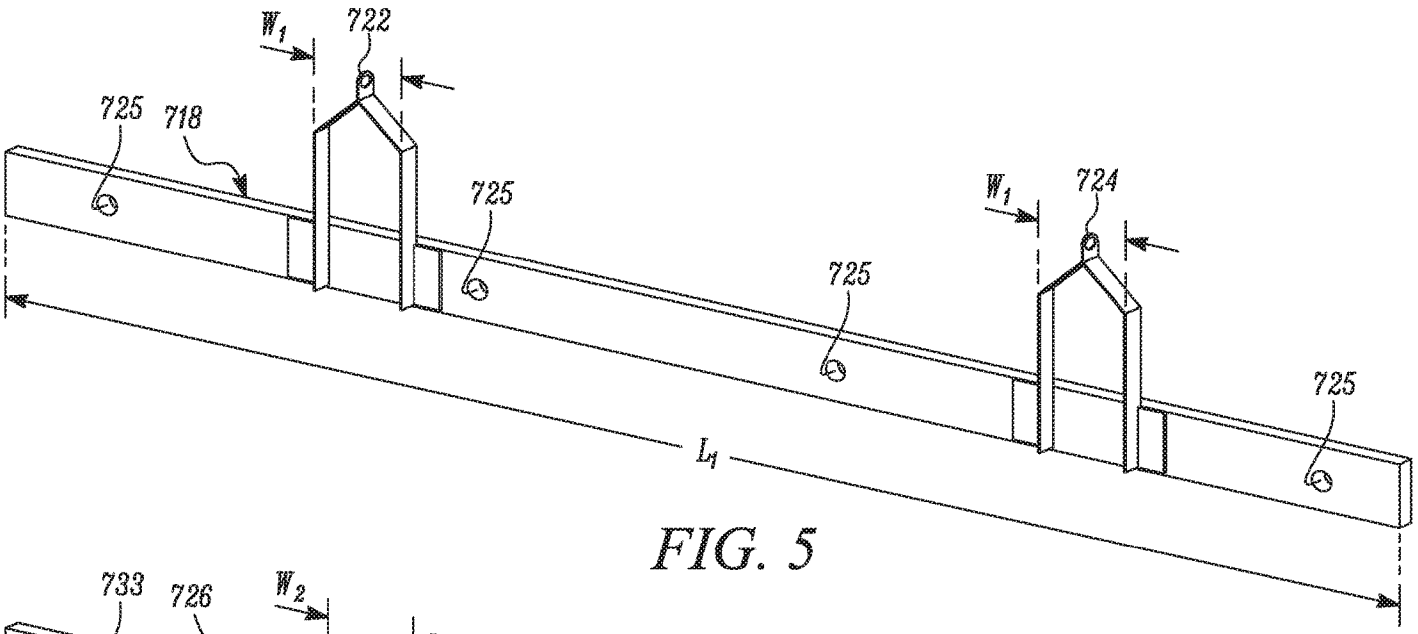
FIG. 5 illustrates a perspective view of an exemplary first bracket of the baffle assembly of FIG. 3, in accordance with the concepts of the present disclosure.

In an embodiment of the present disclosure, the first bracket 718 may include a pair of lifting lugs 722, 724 that are spaced apart from each other, as shown in FIG. 5. The lifting lugs 722, 724 may be connected to the first bracket 718 such as by welding or other suitable fastening means to the first bracket 718 and configured to receive at least one baffle 702 therein. For example, a width $W_1$ of the lifting lugs 722, 724 may be substantially equal to the width $W_B$ of the baffle 702, such that the baffle 702 tight fits into the lifting lugs 722, 724. Alternatively, multiple baffles 702 of the baffle array 704 may be received in each of the lifting lugs 722, 724. The lifting lugs 722, 724 are configured to facilitate lifting of the baffle assembly 700 for installation purposes.

The first bracket 718 may include multiple coupling structures, such as fastening apertures 725 configured to facilitate coupling of the first bracket 718 to the baffles 702 as well as coupling the baffle assembly 700 to the duct, such as the exhaust duct 504 of the gas turbine engine 100 or the exhaust ducting 616 and/or the inlet ducting 614 of the gas turbine engine enclosure 600. For example, the fastening apertures 725 may interface with corresponding complimentary fastening apertures provided on the baffles 702 (not shown) and the duct to facilitate fastening of the first bracket 718 with the baffles 702 as well as the duct. Alternatively, the first bracket 718 may be welded to the baffles 702 and may include the fastening apertures 725 to facilitate fastening of the baffle assembly 700 inside the duct.

Returning to FIG. 3, according to an embodiment, the baffle assembly 700 may further include a third bracket 726 and a fourth bracket 728 coupled to the first side 706 and the second side 708, respectively, of the baffles 702. As illustrated in FIG. 3, the third bracket 726 and the fourth bracket 728 are coupled to each of the baffles 702 proximal to the outlet face 712. The third bracket 726 and the fourth bracket 728 are identical to each other and attach to the first side 706 and the second side 708 in an identical manner, such as by fastening and/or welding techniques. The third bracket 726 and the fourth bracket 728 are described in greater detail in conjunction to FIG. 6 along with FIG. 3 in the following description.

It may be contemplated that the fourth bracket 728, being identical to the third bracket 726, will include identical features as that of the third bracket 726 described herein. The third bracket 726 defines an elongated rectangular profile having a length $L_2$, which is greater than the length L of the baffle array 704, but less than the length $L_1$ of the first bracket 718.

Figure 6:
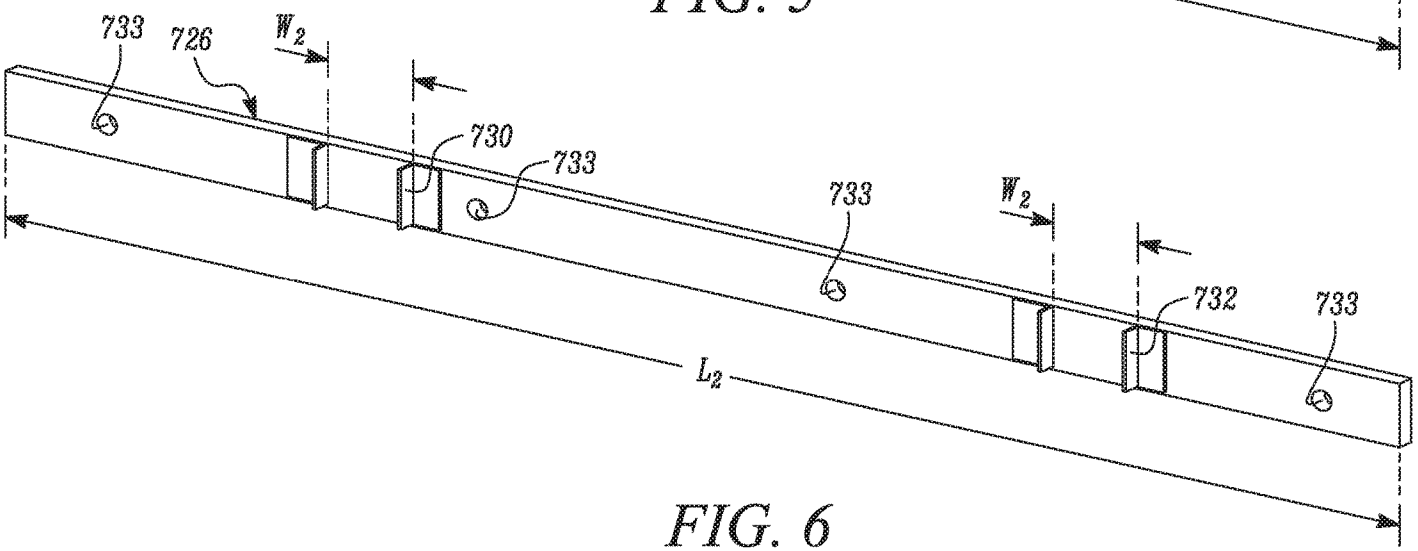
FIG. 6 illustrates a perspective view of an exemplary third bracket of the baffle assembly of FIG. 3, in accordance with the concepts of the present disclosure.

The third bracket 726 may include a pair of alignment lugs 730, 732 spaced apart from each other, as shown in FIG. 6. The alignment lugs 730, 732 may be connected to the to the third bracket 726 such as by welding or other suitable attachment means and configured to receive at least one baffle 702 of the baffle array 704, therein. For example, similar to the lifting lugs 722, 724, a width $W_2$ of the alignment lugs 730, 732 may be substantially equal to the width $W_B$ of the baffle 702, such that the baffle 702 tight fits into the alignment lugs 730, 732. The alignment lugs 730, 732 are configured to facilitate alignment of the baffles 702 in the baffle assembly 700 and inside the duct during operation.

The third bracket 726 may include multiple coupling structures, such as fastening apertures 733 configured to facilitate coupling of the third bracket 726 to the baffles 702 as well as coupling the baffle assembly 700 to the duct. For example, the fastening apertures 733 may interface with corresponding complimentary fastening apertures provided on the baffles 702 and the duct to facilitate fastening of the third bracket 726 with the baffles 702 as well as the duct. Alternatively, the third bracket 726 may be welded to the baffles 702 and may include the fastening apertures 733 to facilitate fastening of the baffle assembly 700 inside the duct.

Figure 7:
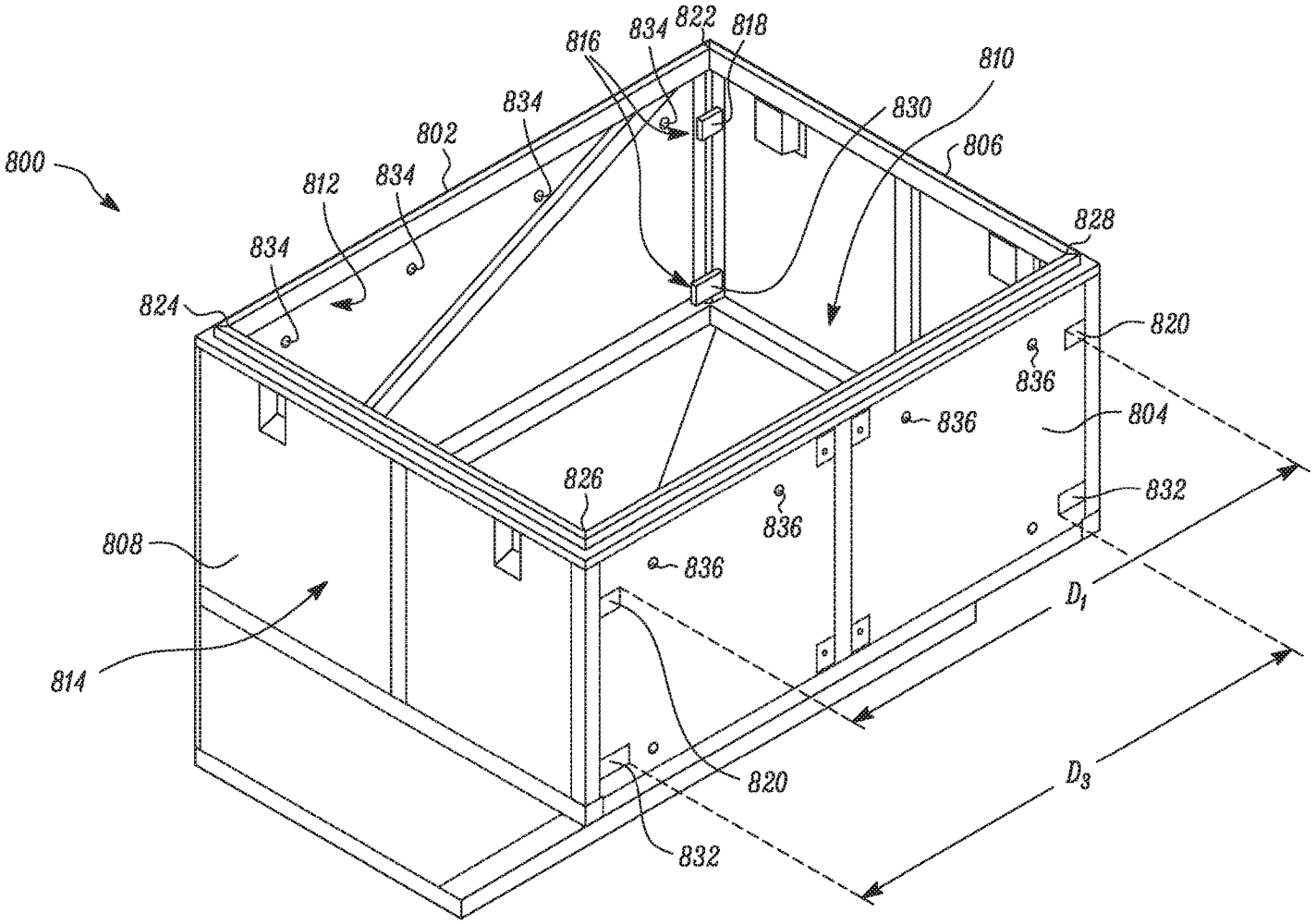
FIG. 7 illustrates an exemplary duct, in accordance with the concepts of the present disclosure.
Figure 8:
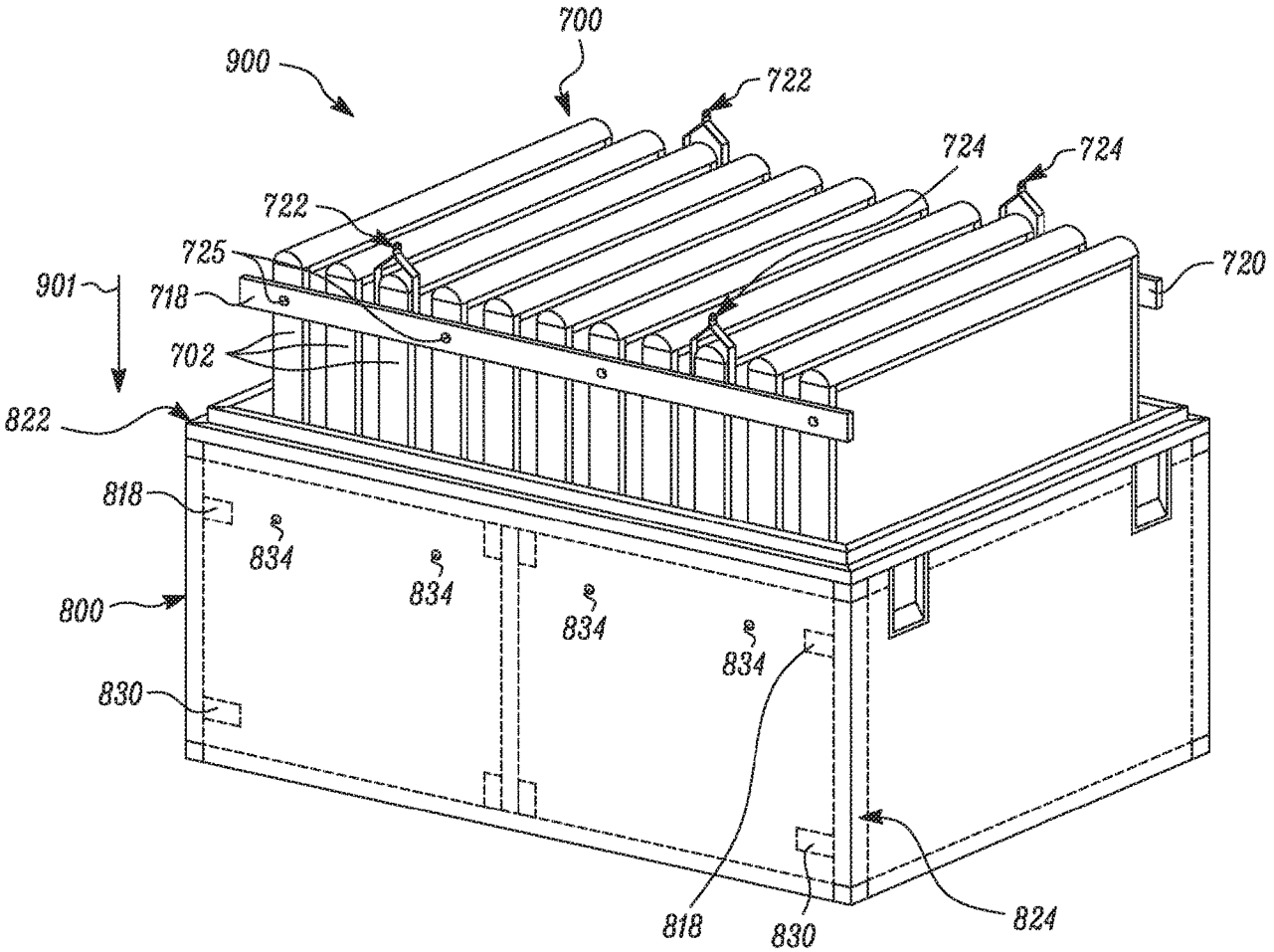
FIG. 8 illustrates an exemplary duct assembly having the duct and the baffle assembly, in accordance with the concepts of the present disclosure.

FIG. 7 illustrates an exemplary duct 800 configured to be in communication with the gas turbine engine 100. FIG. 8 illustrates an exemplary duct assembly 900 having the baffle assembly 700 positioned inside the duct 800. It may be contemplated that the duct 800 may be the exhaust duct 504 of the gas turbine engine 100 and/or the inlet ducting 614 and/or the exhaust ducting 616 of the gas turbine engine enclosure 600 that encloses the gas turbine engine 100.

The duct 800 includes a first pair of laterally opposite walls 802, 804 and a second pair of opposite walls 806, 808 defining an enclosed hollow space 810. The duct 800 has an inner surface 812 and an outer surface 814 defined by the walls 802, 804, 806, and 808. In an embodiment of the present disclosure, the duct 800 includes a support structure 816 provided on the inner surface 812 and configured to support the baffle assembly 700. For example, the support structure 816 is configured to engage with the first bracket 718, the second bracket 720, the third bracket 726 and the fourth bracket 728 to support the baffle assembly 700 inside the duct 800.

In an embodiment of the present disclosure, the support structure 816 includes a pair of first bracket support 818 (only one shown in FIG. 7) and a pair of second bracket support 820 provided on an inner surface of the first pair of opposite walls 802, 804 respectively. The pair of first bracket support 818 and the pair of second bracket support 820 are configured to engage with the first bracket 718 and the second bracket 720, respectively, of the baffle assembly 700 as the baffle assembly 700 is positioned, as shown by arrow 901, within the duct 800.

One of the pair of first bracket support 818 is provided on the inner surface of the wall 802 at a first edge 822. Further, the other one (shown in FIG. 8) of the pair of first bracket support 818 is provided on the inner surface of the first wall 802 at a second edge 824. Similarly, one of the pair of second bracket support 820 is provided on the inner surface of the wall 804 at the third edge 826 and the other one of the pair of second bracket support 820 is provided on the inner surface of the wall 804 at the fourth edge 828.

The pair of first bracket support 818 and the pair of second bracket support 820 may be spaced apart by a first distance $D_1$. Alternatively, the pair of second bracket support 820 may be spaced apart by a second distance (not shown) different than the first distance $D_1$. In an embodiment of the present disclosure, the first distance D1 is smaller than the length $L_1$ of the first bracket 718 and the second bracket 720. Further, the first distance $D_1$ is greater than the length $L_2$ of the third bracket 726 and the fourth bracket 728. In case the first distance $D_1$ is different from the second distance, then the first distance $D_1$ is less than the length of the corresponding first bracket 718 and the second distance is less than the length of the corresponding second bracket 720.

The support structure 816 further includes a pair of third bracket support 830 and a pair of fourth bracket support 832 provided on the inner surface of the walls 802, 804, respectively. The pair of third bracket support 830 and the pair of fourth bracket support 832 are configured to engage with the third bracket 726 and the fourth bracket 728 respectively of the baffle assembly 700. As shown in FIG. 7, the pair of third bracket support 830 and the pair of fourth bracket support 832 may be provided vertically spaced apart from the pair of first bracket support 818 and the pair of second bracket support 820 respectively.

Similar to the pair of first bracket support 818, the pair of third bracket support 830 are also provided on the inner surface of the wall 802 at the first edge 822 and the second edge 824. Further, similar to the pair of second bracket support 820, the pair of fourth bracket support 830 is provided on the inner surface of the wall 802 at the third edge 826 and the fourth edge 828.

The pair of third bracket support 830 and the pair of fourth bracket support 832 is spaced apart by a third distance $D_3$. Alternatively, the pair of fourth bracket support 832 may be spaced apart by a fourth distance (not shown) different than the third distance $D_3$. In an embodiment of the present disclosure, the third distance $D_3$ is substantially equal to the length $L_2$ of the third bracket 726 and the fourth bracket 728. In case the third distance $D_3$ is different from the fourth distance, then the third distance $D_3$ is substantially equal to the length of the corresponding third bracket 726 and the fourth distance is substantially equal to the length of the corresponding fourth bracket 728. The pair of third bracket support 830 is configured to receive the third bracket 726 therebetween. Similarly, the pair of fourth bracket support 832 is configured to receive the fourth bracket 728 therebetween.

The duct 800 further includes a number of fastening apertures 834, 836 provided on the walls 802, 804 respectively. The fastening apertures 834 and 836 are configured to align with the fastening apertures 725 provided on the first bracket 718 and the second bracket 720 respectively. The aligned apertures may further receive fasteners therethrough to fasten the baffle assembly 700 within the duct 800.

Although, the foregoing description is provided in conjunction to the noise attenuation baffle assembly 700 being used to suppress turbine engine noise, it may be well contemplated that the baffle assembly 700 may be used in any duct environment that drives air between a source and a destination, such as in pumps, motors, Heating Ventilation, and Air Conditioning systems (HVAC) used in buildings, etc.

INDUSTRIAL APPLICABILITY

The present disclosure generally applies to ducts used to provide passageways for air between a source and a destination, such as in turbomachines. However, the described embodiments are not limited to use in conjunction to the turbomachines, but rather may be applied to any other duct environment such as ducts used in pumps, motors, Heating Ventilation, and Air Conditioning systems (HVAC) used in buildings, etc.

Figure 9B:
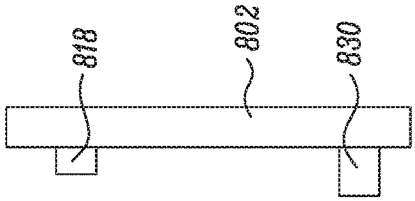
FIGS. 9*a* to 9*c* illustrate steps for assembling the duct assembly, in accordance with the concepts of the present disclosure.
Figure 9A:
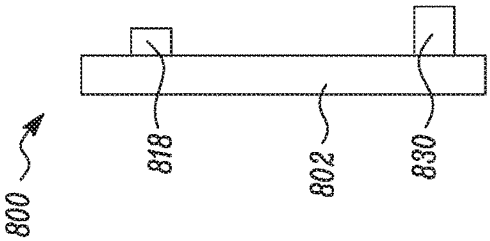
Figure 9A:
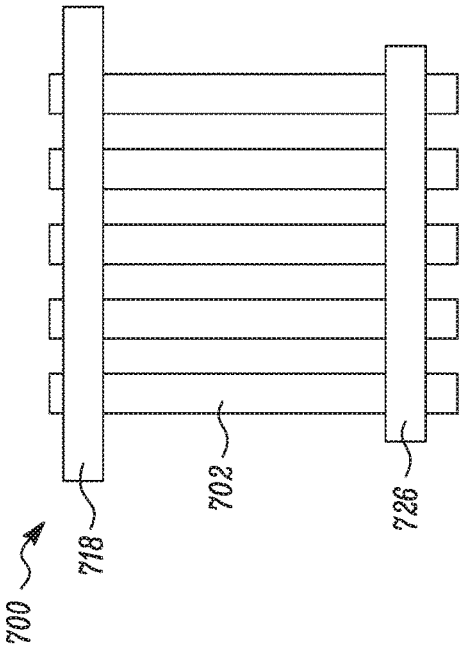

According to an embodiment of the present disclosure, the baffle assembly 700 is first assembled remotely by arranging the baffles 702 spaced apart from one another and coupling the first bracket 718 and the third bracket 726 to the first side 706 of the baffles 702, as shown in FIG. 9*a*. Similarly, the second bracket 720 and the fourth bracket 728 are coupled to the second side 708 of the baffles 702 (not shown). Once the baffle assembly 700 is assembled, it is positioned inside the duct 800.

Figure 9C:
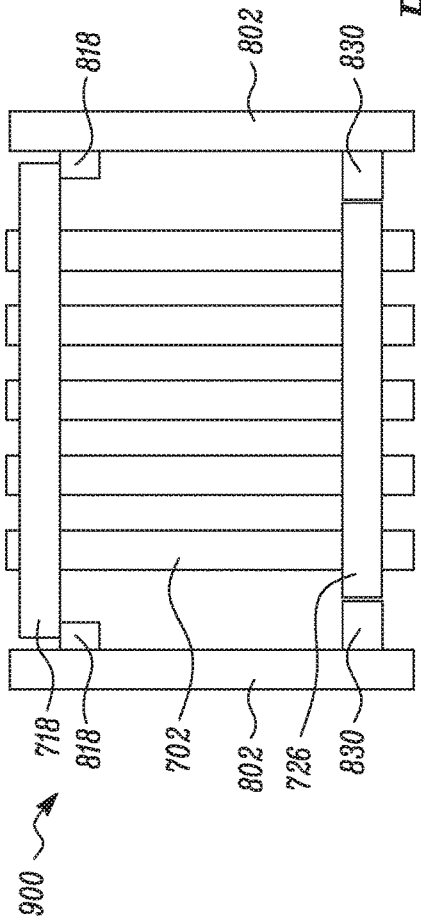

The duct 800 includes the support structure 816 to engage with the brackets of the baffle assembly 700. For example, as shown in FIGS. 9*b* and 9*c*, when the baffle assembly 700 is positioned inside the duct 800, the third bracket 726 passes through the pair of first bracket support 818 and fits between the pair of third bracket support 830. Further, the first bracket 718 abuts the pair of first bracket support 818. The third bracket 726 aligns the baffle assembly 700 together with the duct 800 so that the baffles 702 do not move with the force of air. The first bracket 718 rests on the pair of first bracket support 818 to position the baffle assembly 700 rigidly inside the duct 800. Further, the aligned apertures on the first bracket 718 and the duct 800 may then receive fasteners therethrough to fasten the baffle assembly 700 inside the duct 800.

The second bracket 720 and the fourth bracket 728 engage with the respective pair of second bracket support 820 and the pair of fourth bracket support 832 provided on the wall 804 of the duct 800 in a similar manner as described in conjunction to the first bracket 718 and the third bracket 726, above.

The baffle assembly 700 and the duct 800 of the present disclosure facilitate flexible and inexpensive duct design for the machines, such as for the gas turbine engine 100. The baffle assembly 700 may be first assembled separately from the duct 800, thereby eliminating the conventional individual mounting of each and every baffle inside the duct. The assembled baffle assembly 700 can then be easily installed or removed from inside the duct 800. In addition, any changes to the design and dimensions of the baffles 702 may be accommodated easily without requiring to replace the entire duct assembly 900, thereby decreasing the down time of the gas turbine engine 100.

FIGS. 10*a* to 10*c* illustrate an alternative embodiment of the present disclosure when multiple ducts 800 each structured to house its own respective baffle assemblies 700, 700' may be stacked over one another. In an alternative embodiment, a single duct 800 may be configured to house multiple baffle assemblies 700, 700'. The first baffle assembly 700 includes the first bracket 718 and the third bracket 726 coupled to the baffles 702 on the first side 706. Similarly, the second baffle assembly 700' includes the first bracket 718' and the third bracket 726'.

The stacked ducts 800 include a first pair of first bracket support 818, a first pair of third bracket support 830, a second pair of first bracket support 818' and a second pair of third bracket support 830'. A length of the first bracket 718' of the second baffle assembly 700' is less than a distance between first pair of first bracket support 818 and first pair of third bracket support 830 and greater than a distance between second pair of first bracket support 818', such that the first bracket 718' passes through the first pair of first bracket support 818 and the first pair of third bracket support 830 and finally rests on the second pair of first bracket support 818'.

Similarly, a length of the third bracket 726' of the second baffle assembly 700' is less than the first pair of first bracket support 818, the first pair of third bracket support 830 and the second pair of first bracket support 818'. Further, the length of the third bracket 726' of the second baffle assembly 700' is substantially equal to the second pair of third bracket support 830' such that the third bracket 726' passes through to rest between the second pair of third bracket support 830'.

Similarly, the first baffle assembly 700 may be stacked and positioned in the duct 800 to rest the third bracket 726 between the first pair of third bracket support 830 and to engage the first bracket 718 with the first pair of first bracket support 818.

It may be contemplated that although only two stacked ducts are shown in the illustrated embodiments, any number of ducts and baffle assemblies may be stacked over one another in a similar manner.

The baffle assemblies 700, 700' may also be removed easily one by one in a similar manner. Additionally, failure of one of baffle assemblies 700, 700' may be easily repaired by removing and replacing only the damaged baffle assembly instead of the entire duct assembly, as done conventionally.

While aspects of the present disclosure have been particularly shown, and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof.

What is claimed is:

1. A noise attenuation baffle assembly configured to be positioned inside a duct, the baffle assembly comprising:

a plurality of baffles, wherein each baffle in the plurality of baffles is arranged in a spaced apart relation to one another, and each of the baffle including a first side and a second side;

a first bracket coupled to the first side of each baffle of the plurality of baffles;

a second bracket coupled to the second side of each baffle of the plurality of baffles, the first bracket and the second bracket being configured to be coupled to the duct;

a third bracket coupled to the first side of each baffle of the plurality of baffles; and a fourth bracket coupled to the second side of each baffle of the plurality of baffles:

wherein a length of the first bracket and the second bracket is greater than a length of the third bracket and the fourth bracket respectively.

2. The baffle assembly of claim 1, wherein at least one of the first bracket and the second bracket includes at least one lifting lug to facilitate lifting of the baffle assembly.

3. The baffle assembly of claim 1, wherein the third bracket and the fourth bracket include at least one alignment lug configured to engage with at least one baffle amongst the plurality of baffles to facilitate alignment of at least one baffle in the baffle assembly.

4. The baffle assembly of claim 1, wherein the duct comprises at least one of an inlet ducting or an exhaust ducting for a turbine engine enclosure.

5. The baffle assembly of claim 1, wherein the duct comprises an exhaust duct for a turbine engine.

6. A duct assembly in communication with a turbine engine, the duct assembly comprising:

a duct having an inner surface, wherein the inner surface includes a support structure; and a baffle assembly positioned inside the duct, the baffle assembly including:

a plurality of baffles, wherein each baffle in the plurality of baffles is arranged in a spaced apart relation to one another, each of the baffle including a first side and a second side;

a first bracket coupled to the first side of each baffle of the plurality of baffles; and a second bracket coupled to the second side of each baffle of the plurality of baffles, wherein the first bracket and the second bracket engage with the support structure of the duct;

wherein the support structure includes a pair of first bracket support and a pair of second bracket support provided on a first wall and a second wall of the inner surface, the first wall being laterally opposite to the second wall.

7. The duct assembly of claim 6, further comprising:

a third bracket coupled to the first side of each baffle of the plurality of baffles; and a fourth bracket coupled to the second side of each baffle of the plurality of baffles.

8. The duct assembly of claim 6, wherein at least one of the first bracket and the second bracket include a lifting lug configured to facilitate lifting of the baffle assembly.

9. The duct assembly of claim 7, wherein the third bracket and the fourth bracket include at least one alignment lug configured to engage with at least one baffle amongst the plurality of baffles to facilitate alignment of at least one baffle in the baffle assembly.

10. The duct assembly of claim 7, wherein each of the first bracket, the second bracket, the third bracket and the fourth bracket includes a plurality of coupling structures to couple each of the first bracket, the second bracket, the third bracket and the fourth bracket to each of the baffles of the plurality of baffles.

11. The duct assembly of claim 6, wherein the first bracket and the second bracket engage with the pair of first bracket support and the pair of second bracket supports respectively.

12. The duct assembly of claim 7, wherein the support structure includes a pair of third bracket support and a pair of fourth bracket support provided on a first wall and a second wall of the inner surface, the first wall being laterally opposite to the second wall.

13. The duct assembly of claim 12, wherein the third bracket and the fourth bracket engage with the pair of third bracket support and the pair of fourth bracket support respectively.

14. The duct assembly of claim 6, wherein the pair of first bracket support is spaced apart by a first distance, the first distance being smaller than a length of the first bracket; and the pair of second bracket support is spaced apart by a second distance, the second distance being smaller than a length of the second bracket.

15. The duct assembly of claim 13, wherein the pair of third bracket support is spaced apart such that the third bracket is received therebetween; and the pair of fourth bracket support is spaced apart such that the fourth bracket is received therebetween.

16. The duct assembly of claim 6 wherein said duct is provided in at least one of a turbine engine exhaust or a turbine enclosure.

17. A duct assembly in communication with a turbine engine, the duct assembly comprising:

a duct having an inner surface, wherein the inner surface includes a support structure; and a baffle assembly positioned inside the duct, the baffle assembly including:

a plurality of baffles, wherein each baffle in the plurality of baffles is arranged in a spaced apart relation to one another, each of the baffle including a first side and a second side;

a first bracket coupled to the first side of each baffle of the plurality of baffles; and a second bracket coupled to the second side of each baffle of the plurality of baffles, wherein the first bracket and the second bracket engage with the support structure of the duct:

a third bracket coupled to the first side of each baffle of the plurality of baffles; and a fourth bracket coupled to the second side of each baffle of the plurality of baffles;

wherein the support structure includes a pair of third bracket support and a pair of fourth bracket support provided on a first wall and a second wall of the inner surface, the first wall being laterally opposite to the second wall.

18. The duct assembly of claim 17, wherein the third bracket and the fourth bracket engage with the pair of third bracket support and the pair of fourth bracket support respectively.

19. The duct assembly of claim 17, wherein the third bracket and the fourth bracket include at least one alignment lug configured to engage with at least one baffle amongst the plurality of baffles to facilitate alignment of at least one baffle in the baffle assembly.

* * * * *